US009490522B2

(12) United States Patent
Yang et al.

(10) Patent No.: US 9,490,522 B2
(45) Date of Patent: Nov. 8, 2016

(54) FOLDABLE SATELLITE ANTENNA

(71) Applicant: Wistron NeWeb Corporation, Hsinchu (TW)

(72) Inventors: Lan-Chun Yang, Hsinchu (TW); Shun-Chung Kuo, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 136 days.

(21) Appl. No.: 14/507,846

(22) Filed: Oct. 7, 2014

(65) Prior Publication Data

US 2016/0013562 A1 Jan. 14, 2016

(30) Foreign Application Priority Data

Jul. 14, 2014 (TW) ..... 103124142 A

(51) Int. Cl.
*H01Q 19/12* (2006.01)
*H01Q 1/12* (2006.01)

(52) U.S. Cl.
CPC ..... *H01Q 1/1235* (2013.01)

(58) Field of Classification Search
USPC ..... 343/840, 882, 872
See application file for complete search history.

(56) References Cited

U.S. PATENT DOCUMENTS 7,138,958 B2 * 11/2006 Syed ..... H01Q 19/19 343/781 P
2001/0045913 A1 * 11/2001 Fedder ..... H01Q 1/125 343/882
2008/0099643 A1 * 5/2008 Lin ..... H01Q 1/125 248/237

FOREIGN PATENT DOCUMENTS

TW M453255 U1 5/2013

* cited by examiner

*Primary Examiner* — Hoang V Nguyen
*Assistant Examiner* — Hai Tran
(74) *Attorney, Agent, or Firm* — Winston Hsu; Scott Margo

(57) ABSTRACT

A foldable satellite antenna includes a dish reflector formed with an opening, a connecting rod having a section smaller than the opening such that the connecting rod is able to be inserted through the opening to penetrate the dish reflector, a compensating structure for being disposed in an area enclosed by the opening to fill an area other than where the connecting rod penetrating the opening after the connecting rod is inserted through the opening to penetrate the dish reflector, and a dish bracket for riveting the dish reflector and the connecting rod such that the connecting rod is folded around a rotating center of the dish bracket after the connecting rod is inserted through the opening to penetrate the dish reflector.

7 Claims, 15 Drawing Sheets

FOLDABLE SATELLITE ANTENNA

BACKGROUND OF THE INVENTION

1. Field of the Invention

The present invention relates to a foldable satellite antenna, and more particularly, to a foldable satellite antenna having a compensating structure for compensating an opening in a dish reflector of the satellite antenna.

2. Description of the Prior Art

Satellite communication is distinguished by wide coverage and terrestrial interference avoidance, and is widely used in military, probe, and commercial communication services, such as satellite navigation, satellite voice broadcasting, and satellite television broadcasting. Please refer to FIG. 1, which is a schematic diagram of a conventional satellite antenna 10. The satellite antenna 10 includes a dish reflector 11, a connecting rod 12, a low noise block down-converter with feedhorn (hereafter called LNB) 13 and a pipe 15. A structure of the satellite antenna 10 is well known in the art, which is omitted herein. A structural specialty of the satellite antenna 10 is that the connecting rod 12 is able to be inserted through an opening of the dish reflector 11 to penetrate the dish reflector 11, which enhances a combinative stability between the dish reflector 11 and the connecting rod 12.

Please refer to FIG. 2, which is an enlarged side view of the satellite antenna 10 in a dashed line shown in FIG. 1. As shown in FIG. 2, although the combinative stability between the dish reflector 11 and the connecting rod 12 is enhanced via penetrating the dish reflector 11 by the connecting rod 12, the connecting rod 12 may interfere with the dish reflector 11 if the connecting rod 12 is folded around the dish reflector 11. In addition, a volume of the satellite antenna 10 is quite large when it is completely assembled, therefore the satellite antenna 10 is packaged piecemeal for a single package in order to save packaging materials and delivery spaces. In such a situation, an operator for satellite installation has to assemble the satellite antenna 10 by piecemeal since the satellite antenna 10 cannot be partially or completely assembled in the production lines, which increases installation procedures and workload of the operator and cannot satisfy a requirement of quick installation for customers.

Therefore, there is a need to improve the prior art to satisfy the requirements of quick installation, saving packaging materials and delivery spaces.

SUMMARY OF THE INVENTION

It is therefore an objective of the present invention to provide a foldable satellite antenna having a compensating structure for compensating an opening in a dish reflector of the satellite antenna.

An embodiment of the present invention discloses a foldable satellite antenna including a dish reflector formed with an opening, a connecting rod having a section smaller than the opening such that the connecting rod is able to be inserted through the opening to penetrate the dish reflector, a compensating structure fixed on the connecting rod, wherein the compensating structure fills an area other than where the connecting rod penetrating the opening after the connecting rod is inserted through the opening to penetrate the dish reflector, and a dish bracket for pivoting the connecting rod such that the connecting rod and the compensating structure rotate relative to the dish bracket after the connecting rod is inserted through the opening to penetrate the dish reflector.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
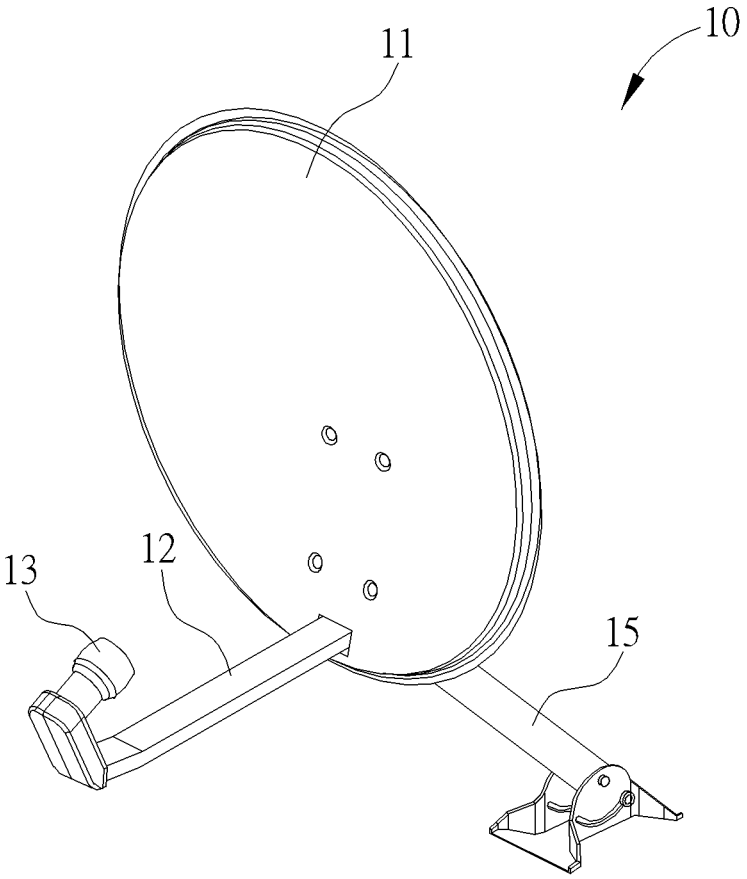
FIG. 1 PRIOR ART
FIG. 1 is a schematic diagram of a conventional satellite antenna.
Figure 2:
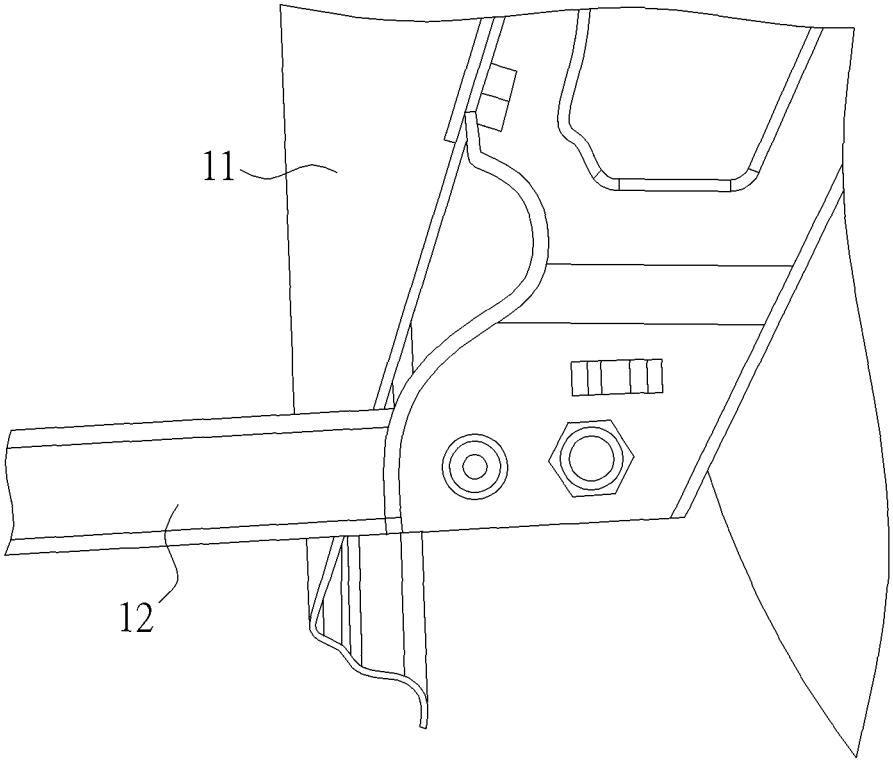
FIG. 2 PRIOR ART
FIG. 2 is an enlarged side view of the satellite antenna in a dashed line shown in FIG. 1.
Figure 3:
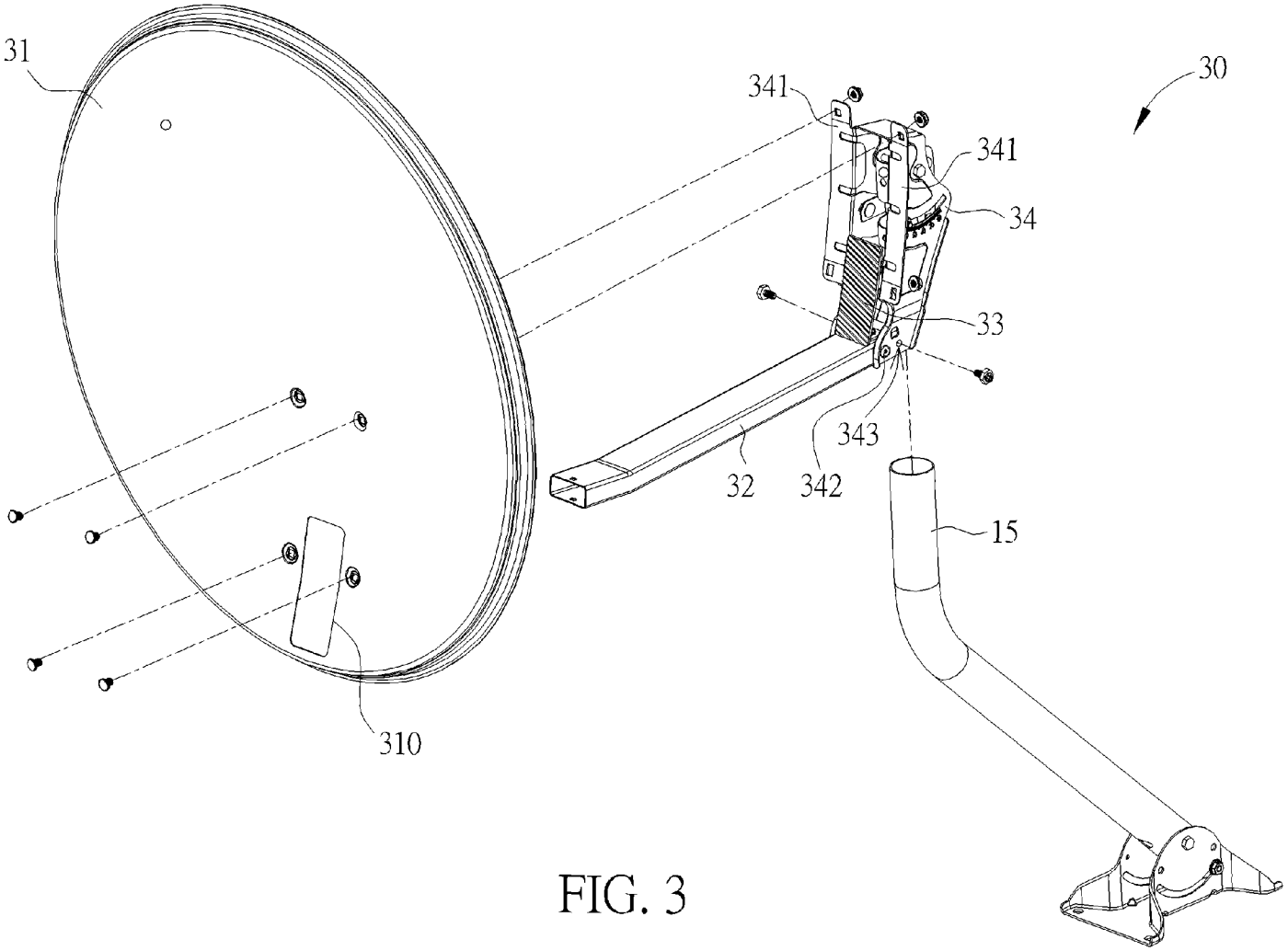
FIG. 3 is an exploded view of a satellite antenna according to an embodiment of the present invention.

Please refer to FIG. 3, which is an exploded view of a satellite antenna 30 according to an embodiment of the present invention. In order to meet requirements of quick installation, saving packaging materials and delivery spaces, the satellite antenna 30 is a foldable satellite antenna to reduce a volume of the satellite antenna 30 when it is semi-assembled, which may reduce packaging materials and delivery spaces for a single package. As shown in FIG. 3, the satellite antenna 30 includes a dish reflector 31, a connecting rod 32, a compensating structure 33, a dish bracket 34, and the pipe 15.

In structure, the dish reflector 31 is formed with an opening 310. The connecting rod 32 has a section smaller than the opening 310 such that the connecting rod 32 is able to be inserted through the opening 310 to penetrate the dish reflector 31. The compensating structure 33 is fixed on the connecting rod, wherein the compensating structure fills an area other than where the connecting rod 32 is inserted in the opening 310 after the connecting rod 32 is inserted through the opening 310 to penetrate the dish reflector 31. The dish bracket 34 is used for pivotally connecting and the connecting rod 32, such that the connecting rod 32 is folded around a rotating center of the dish bracket 34 after the connecting rod 32 is inserted through the opening 310 to penetrate the dish reflector 31. The dish bracket 34 includes connectors 341 and 343, and a pivot 342. The connector 341 is used for connecting the dish reflector 31. The connector 343 is used for connecting the connecting rod 32. The pivot 342 is pivotally connected to the dish bracket 34 and the connecting rod 32, such that the connecting rod 32 is folded around the rivet 342.

Figure 4:
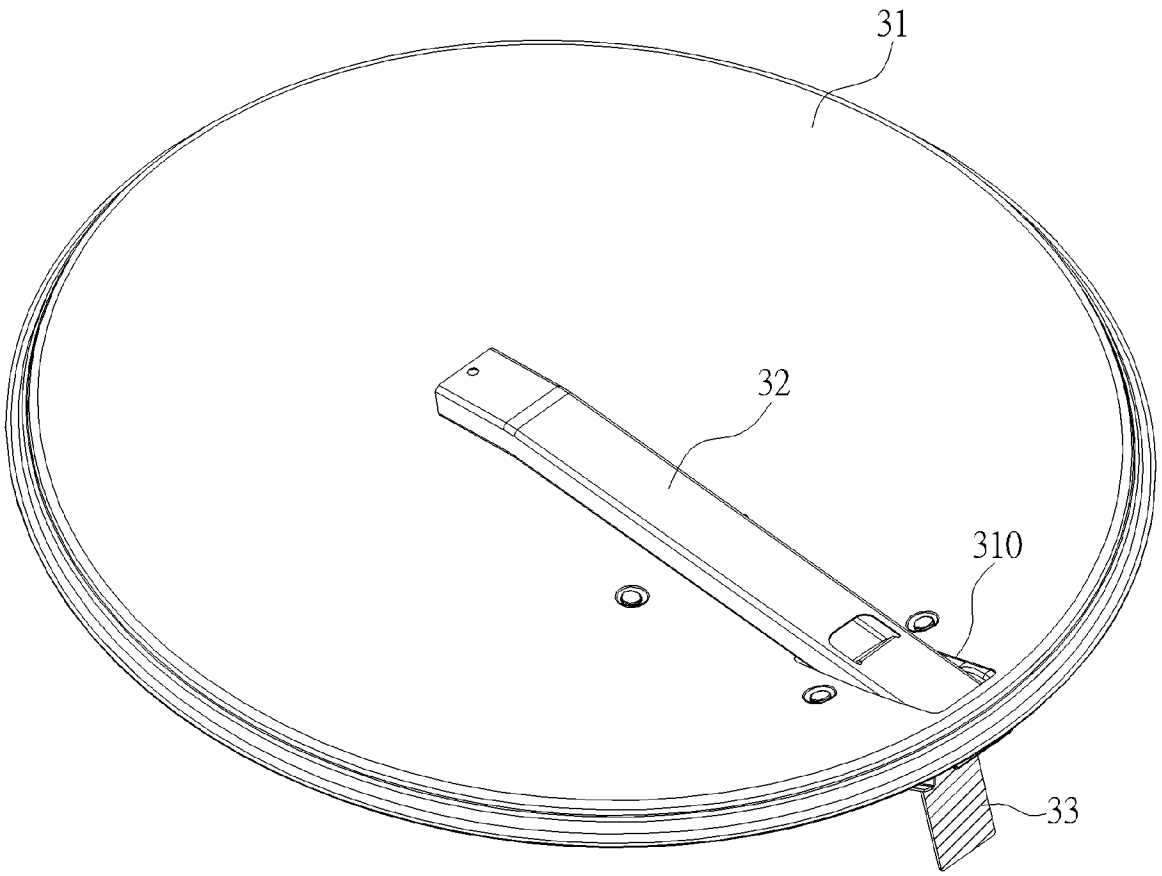
FIG. 4 and FIG. 5 illustrate a front view and a back view of the semi-assembled satellite antenna shown in FIG. 3.
Figure 5:
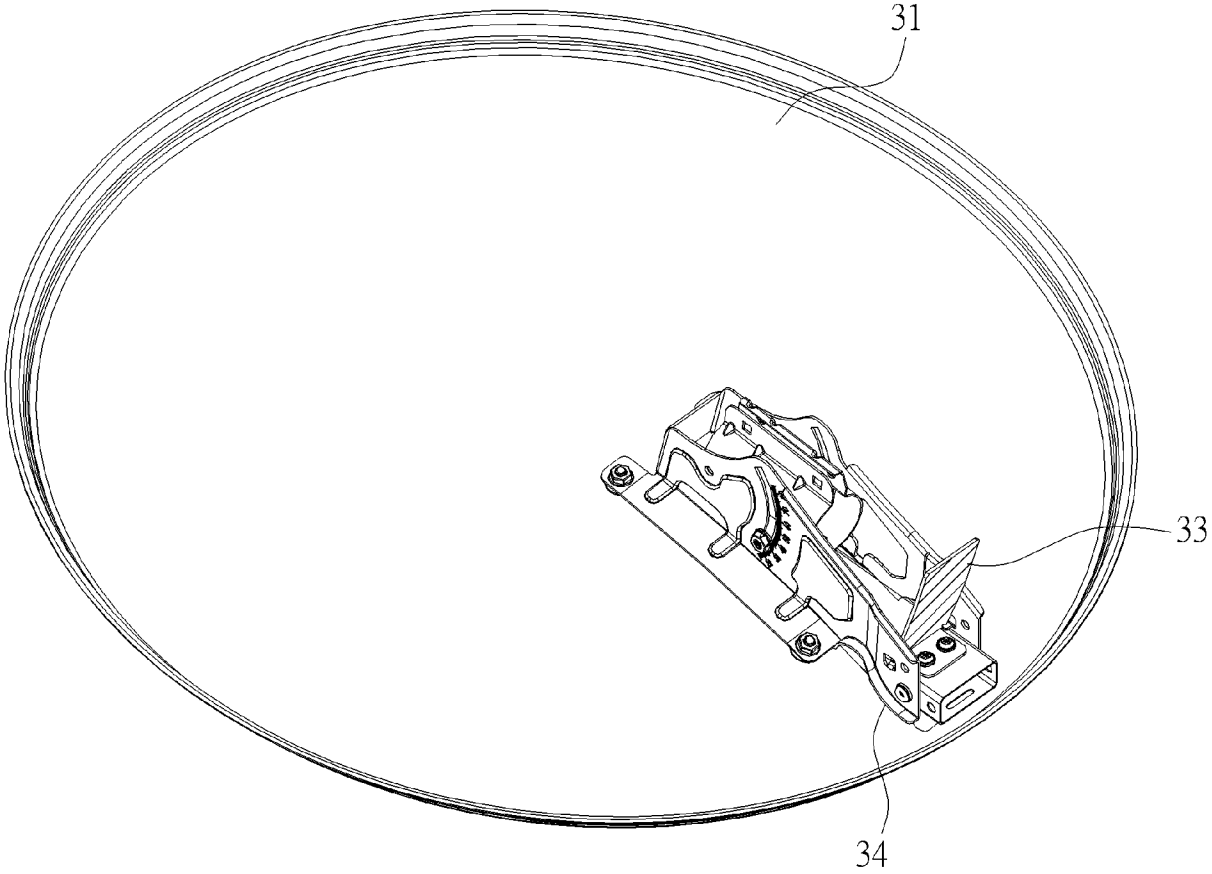

Please refer to FIG. 4 and FIG. 5 at the same time, which illustrate a front view and a back view of the semi-assembled satellite antenna 30. In order to simplify installation procedures for the operator, some parts of the satellite antenna 30 may be assembled by an operator on a production line in advance, such that the satellite antenna 30 is semi-assembled when it is packaged and to deliver to the customers. Specifically, as shown in FIG. 4 and FIG. 5, the operator may pivotally connect the connecting rod 32 and the dish bracket 34, penetrate through the dish reflector 31 via the connecting rod 32 and fold the connecting rod 32 into the dish reflector 31, and finally screw screws to connect the dish reflector 31 and the dish bracket 34, wherein the dish bracket is assumed to be a replaceable part. When the connecting rod 32 is folded in the dish reflector 31, the connecting rod 32 shown in FIG. 4 may completely fill the area enclosed by the opening 310, and the connecting rod 32 is disposed in parallel with the dish reflector 31, which minimizes a volume of the semi-assembled satellite antenna. The compensating structure 33 shown in FIG. 5 is folded in the dish bracket 34 at the back of the dish reflector 31.

Noticeably, the opening 310 formed in the dish reflector 31 is designed for the foldable connecting rod 32 to prevent the connecting rod 32 from interfering with the dish reflector 31 when the connecting rod 32 is folded, thereby the area enclosed by the opening 310 may at least satisfy a minimum area containing the folded connecting rod 32.

As a result, the semi-assembled satellite antenna 30 may simplify the installation procedures for the operator, e.g. save operations for assembling some parts of the satellite antenna 30. Since the satellite antenna 30 has the foldable connecting rod 32, the volume of the semi-assembled satellite antenna 30 may be reduced to reduce the packaging materials and the delivery spaces for a single package, which reduces a total operating cost for the satellite antenna.

In addition, since the dish reflector 31 is used for reflecting and gathering receiving signals to the LNB, the opening 310 may ruin an intactness of the dish reflector 31 when the connecting rod 32 is expanded without the compensating structure 33, which leads to some of the receiving signals being not reflected by the dish reflector 31 and weakens reception performance of the satellite antenna 30. Accordingly, the compensating structure 33 is disposed in the satellite antenna 30 of the present invention for compensating the area enclosed by the opening 310 other than where the connecting rod 32 is inserted in the opening 310 to ensure the intactness of the dish reflector 31, which may ensure the reception performance of the satellite antenna 30.

Figure 6:
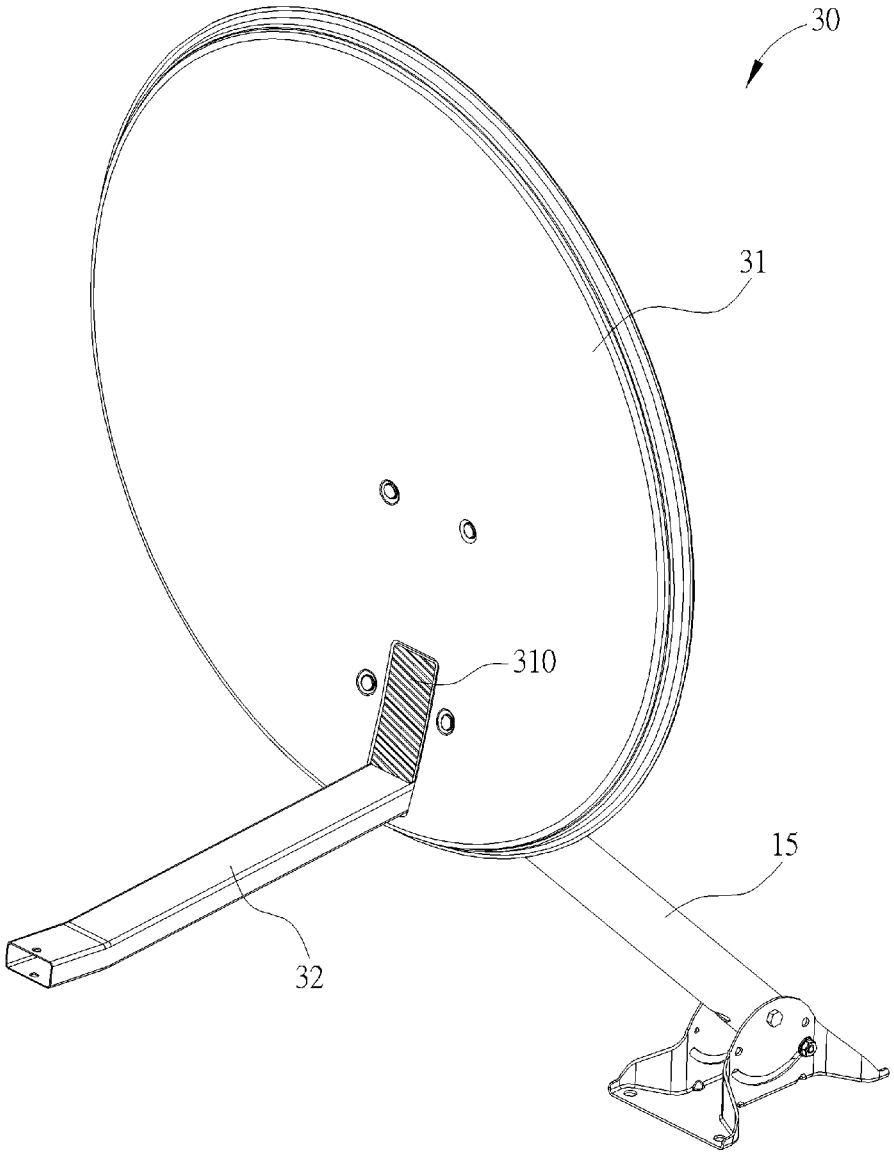
FIG. 6 illustrates the completely assembled satellite antenna shown in FIG. 3.

Specifically, please refer to FIG. 6, which illustrates the completely assembled satellite antenna 30. As shown in FIG. 6, in operation, when the operator is about to assemble the satellite antenna 30, the operator may assemble the semi-assembled satellite antenna 30 shown in FIG. 4 and FIG. 5 with the pipe 15 and other parts, then expand the connecting rod 32 from the dish reflector 31, and finally assemble the LNB or horn antenna (not shown in FIG. 6) at an end of the connecting rod 32 to proceed with the following positioning and signal calibrating operations. Meanwhile, the compensating structure 33 may compensate the area enclosed by the opening 310 other than where the connecting rod 32 is inserted in the opening 310 to ensure the intactness of the dish reflector 31, which may ensure the reception performance of the satellite antenna 30.

In short, the satellite antenna 30 of the present invention may be semi-assembled in the production lines for a single package to simplify the installation procedures for the operator; and the satellite antenna 30 of the present invention has the foldable connecting rod 32, the volume of the semi-assembled satellite antenna 30 may be reduced to reduce the packaging materials and the delivery spaces for a single package, which reduces a total operating cost for the satellite antenna. Meanwhile, the satellite antenna 30 of the present invention is disposed with the compensating structure 33 for compensating the area enclosed by the opening 310 other than where the connecting rod 32 is inserted in the opening 310 to ensure the intactness of the dish reflector 31, which may ensure the reception performance of the satellite antenna 30. As a result, the satellite antenna 30 of the present invention may meet the requirements of quick installation, saving packaging materials and delivery spaces, as well as the reception performance.

Please note that the satellite antenna 30 with the compensating structure 33 corresponding to the opening 310 of the dish reflector 31 is disclosed in the present invention, which is not limited. For example, a volume and a shape of the area enclosed by the opening 310 is unlimited, which may be modified according to a shape or a bent angle of the connecting rod 32, or a curvature of the dish reflector 31. Moreover, structural design and materials of the compensating structure 33 disposed in the satellite antenna 30 are not limited, as long as the intactness of the dish reflector 31 is ensured to reflect receiving signals. For example, the compensating structure 33 may be fixed on the dish reflector 31, the connecting rod 32, or the dish bracket 34. The compensating structure 33 may be a single part or a combination of sub-parts.

Figure 7:
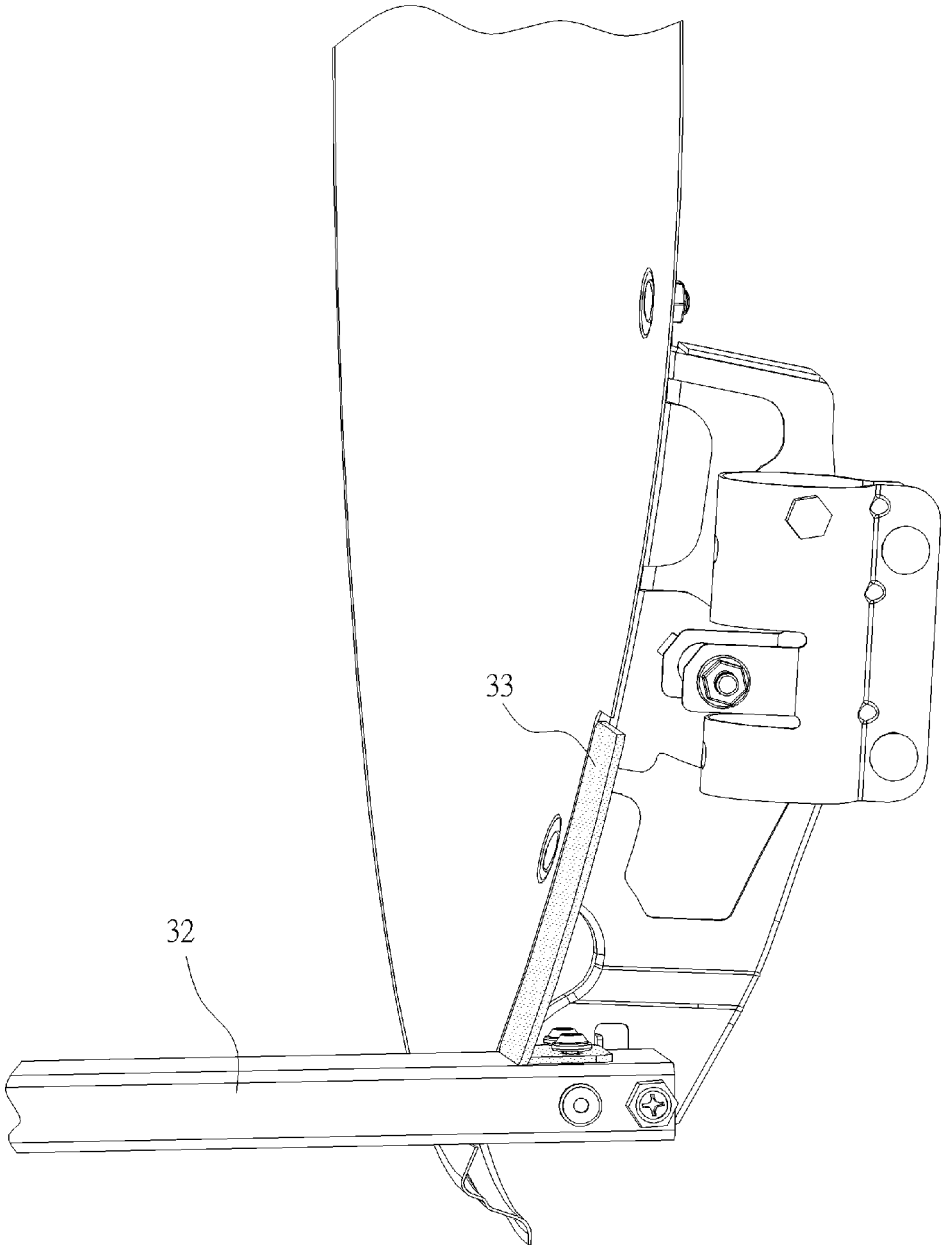
FIG. 7 to FIG. 9 illustrate structural diagrams of the compensating structure fixed on connecting rod shown in FIG. 3 according to first to third embodiments of the present invention.
Figure 8:
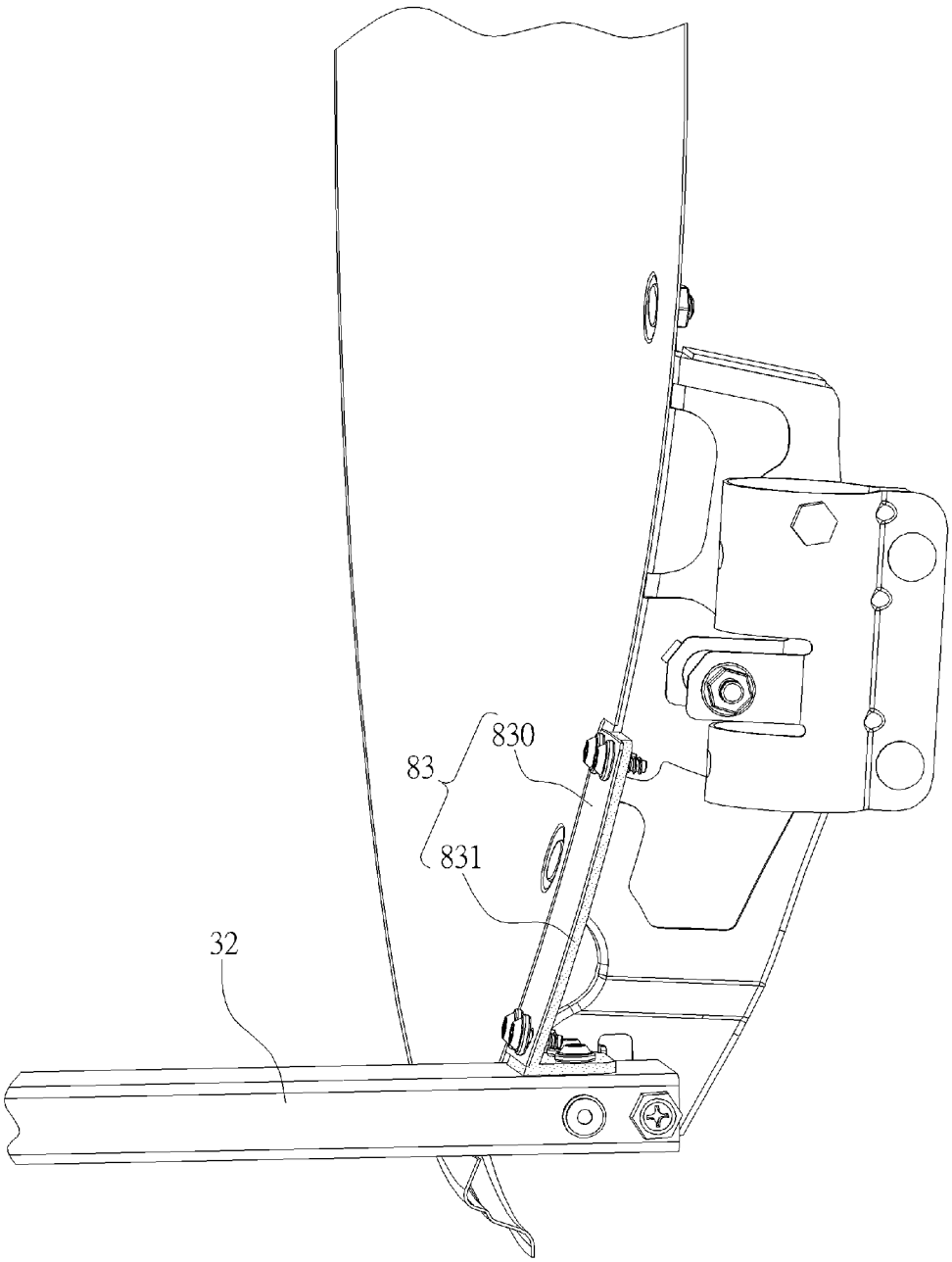
Figure 9:
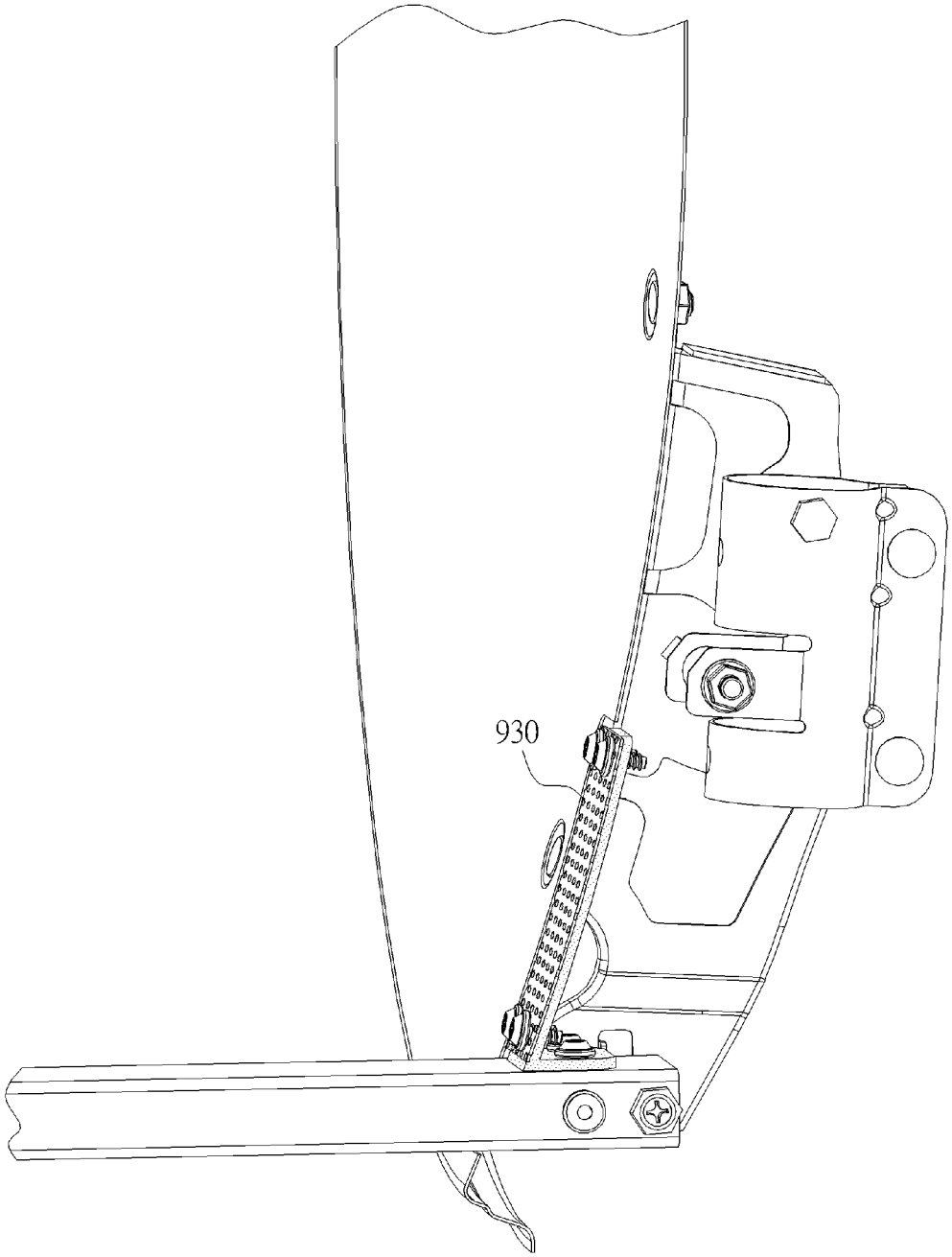

Specifically, please refer to FIG. 7 to FIG. 9, which illustrate structural diagrams of the compensating structure fixed on connecting rod 32 according to first to third embodiments of the present invention. In the first embodiment shown in FIG. 7, the compensating structure 33 is a single part, e.g. a part formed by metal casting molds. Or, the compensating structure 33 may be fixed on the connecting rod 32 by screws.

In the second embodiment shown in FIG. 8, the compensating structure 33 shown in FIG. 7 is replaced by a compensating structure 83. Specifically, the compensating structure 83 includes a compensating plate 830 and a holder 831. The holder 831 is coupled to the compensating plate 830 and the connecting rod 32 for fixing the compensating plate 830, and fixing the compensating structure 83 on the connecting rod 32. Please note that materials of which the compensating plate 830 and the holder 831 are made are not limited, the compensating plate 830 and the holder 831 may be made of same or different materials according to practical requirements.

In the third embodiment shown in FIG. 9, the compensating plate 830 shown in FIG. 8 is replaced by a compensating plate 930. The compensating plate 930 is formed with a plurality of holes to look like a net. Under a circumstance that the receiving signals are well reflected, the net-liked compensating plate 930 may reduce weight and windage to improve a robustness of the satellite antenna in outdoor environments.

In the second and third embodiments, the compensating plates 830 and 930, and the holder 831 are replaceable parts, which may be fixed but not limited to by screws. In the first to third embodiments, the compensating structures 33 and 83 may be assembled on the production lines in advance to save operations for installing the compensating structure, which may improve convenience and save times to the operator.

Figure 10:
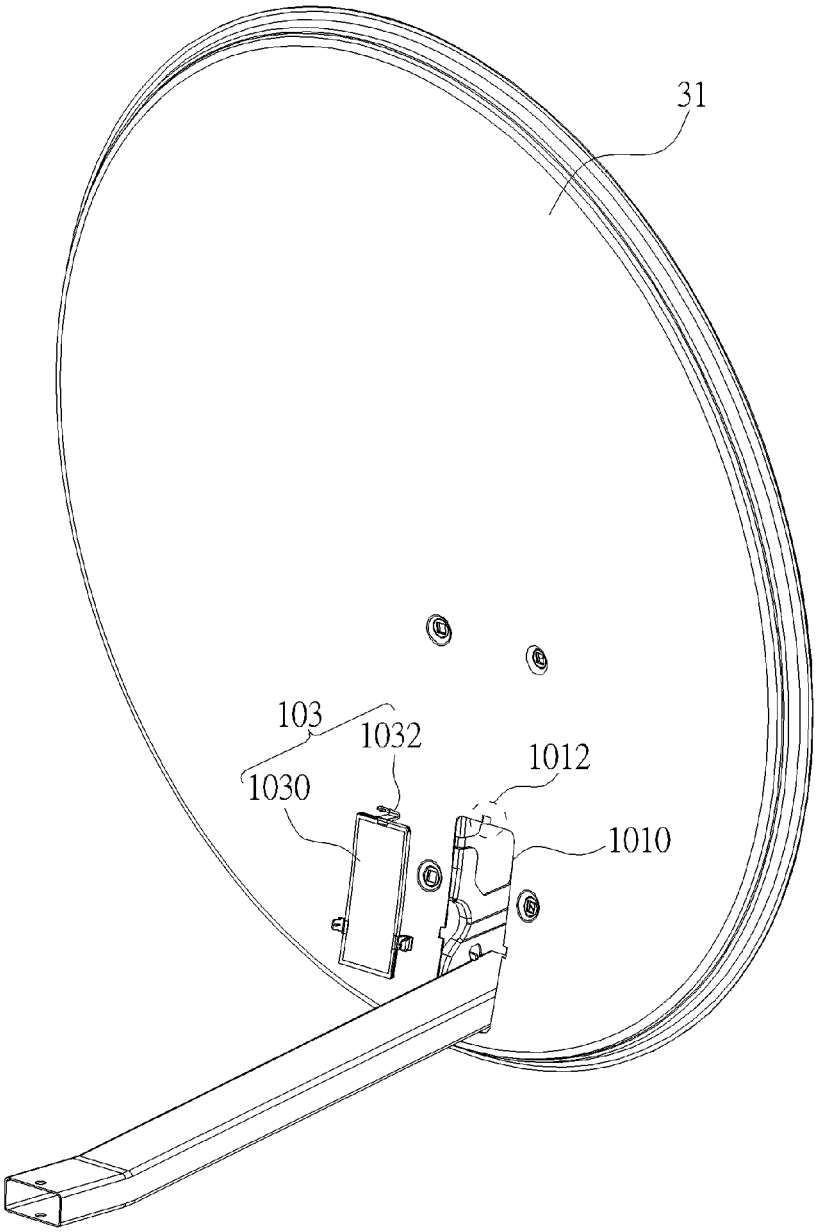
FIG. 10 to FIG. 13 illustrate structural diagrams of the compensating structure fixed on the dish reflector shown in FIG. 3 according to fourth and fifth embodiments of the present invention.
Figure 11:
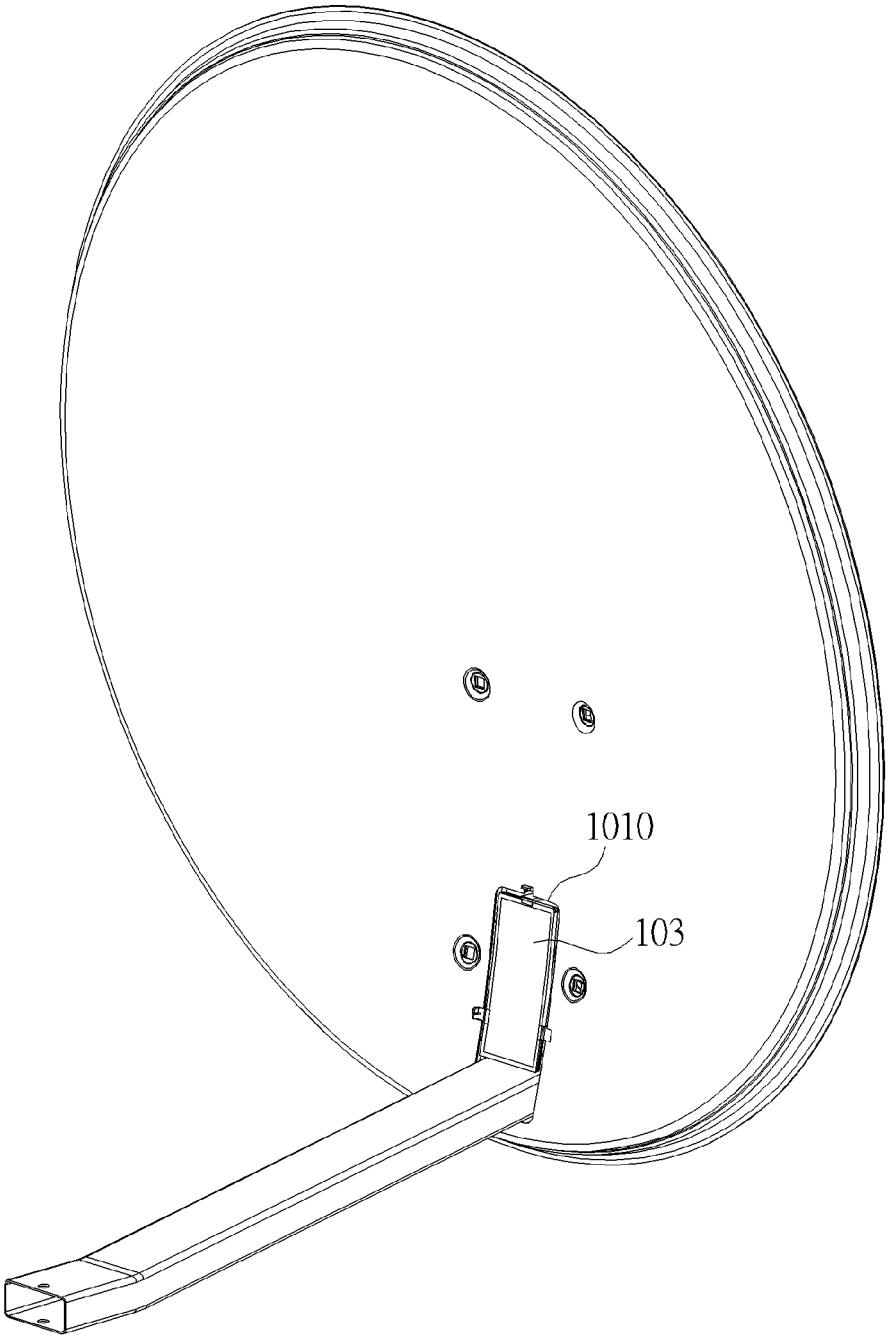

Please refer to FIG. 10 to FIG. 13, which illustrate structural diagrams of the compensating structure fixed on the dish reflector 31 according to fourth and fifth embodiments of the present invention. In the fourth embodiment as shown in FIG. 10, in structure, a border of an opening 1010 is formed with a plurality of slots 1012. The compensating structure 103 includes a compensating plate 1030 and a plurality of hooks 1032. The hooks 1032 are formed at a border of the compensating plate 1030 and are corresponding to the plurality of slots 1012, respectively. One of the plurality of hooks 1032 may be combined with one of the plurality of slots 1012 to fix the compensating structure 103 on the dish reflector. As shown in FIG. 11, in operation, the operator may dispose the compensating structure 103 in the opening 1010 (i.e. put the V-shaped hook 1032 into the slot 1012) to fix the compensating structure 103 on the dish reflector, which is easier than screwing screws to improve the convenience and save times to the operator.

Figure 12:
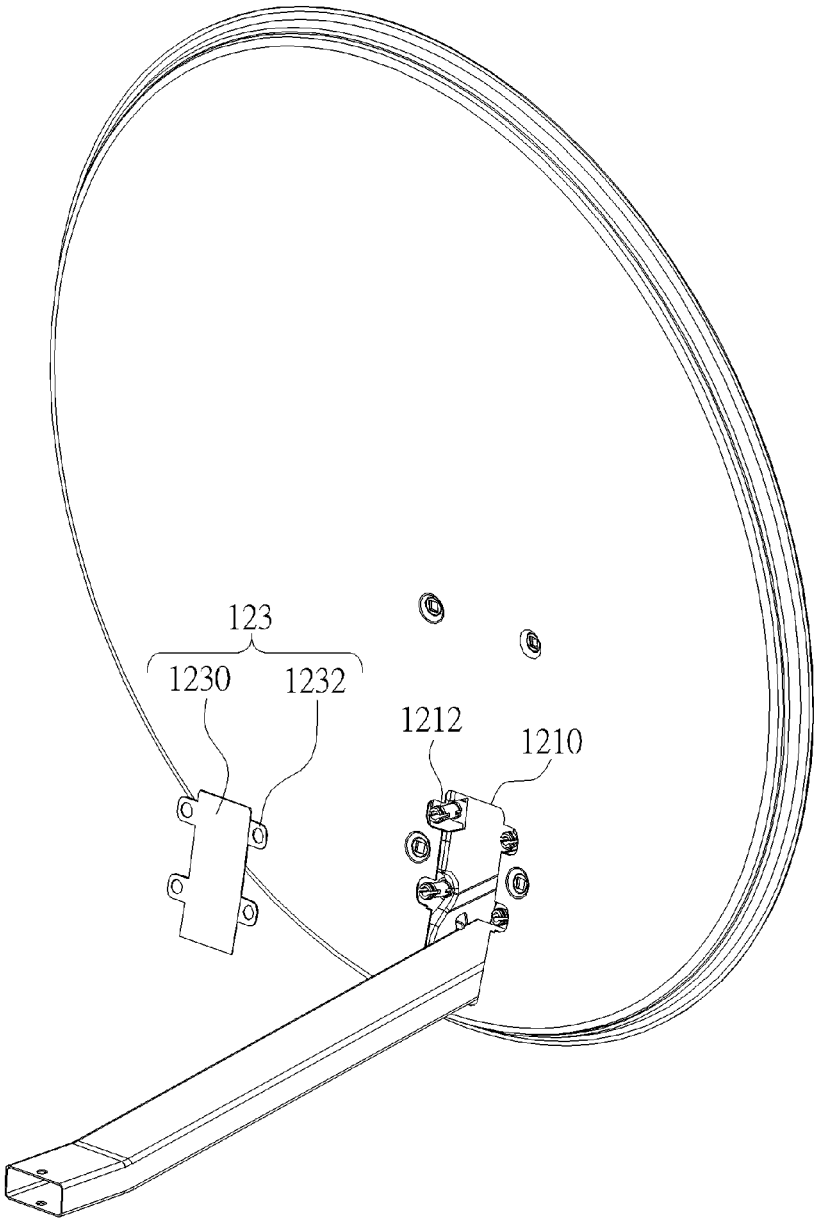
Figure 13:
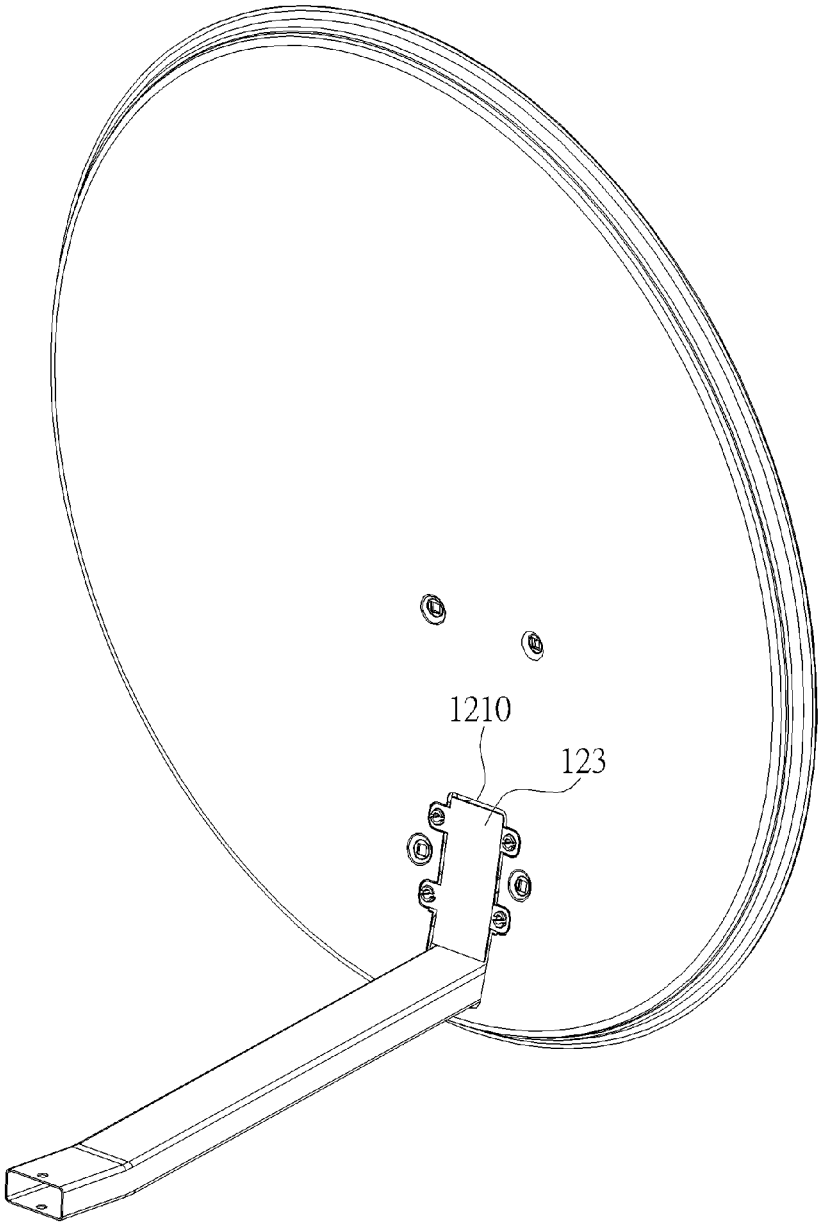

In the fifth embodiment as shown in FIG. 12, in structure, a border of the opening 1210 is formed with a plurality of slots 1212. A compensating structure 123 includes a compensating plate 1230 and a plurality of hooks 1232. The hooks 1232 are formed at a border of the compensating plate 1230 and are corresponding to the plurality of slots 1212, respectively. One of the plurality of hooks 1232 may be combined with one of the plurality of slots 1212 to fix the compensating structure 123 on the dish reflector. As shown in FIG. 13, in operation, the operator may dispose the compensating structure 123 in the opening 1210 (i.e. put the circle-shaped hooks 1232 into the cylinder-shaped slots 1212) to fix the compensating structure 112 on the dish reflector, which is easier than screwing screws to improve the convenience and save times to the operator.

Figure 14:
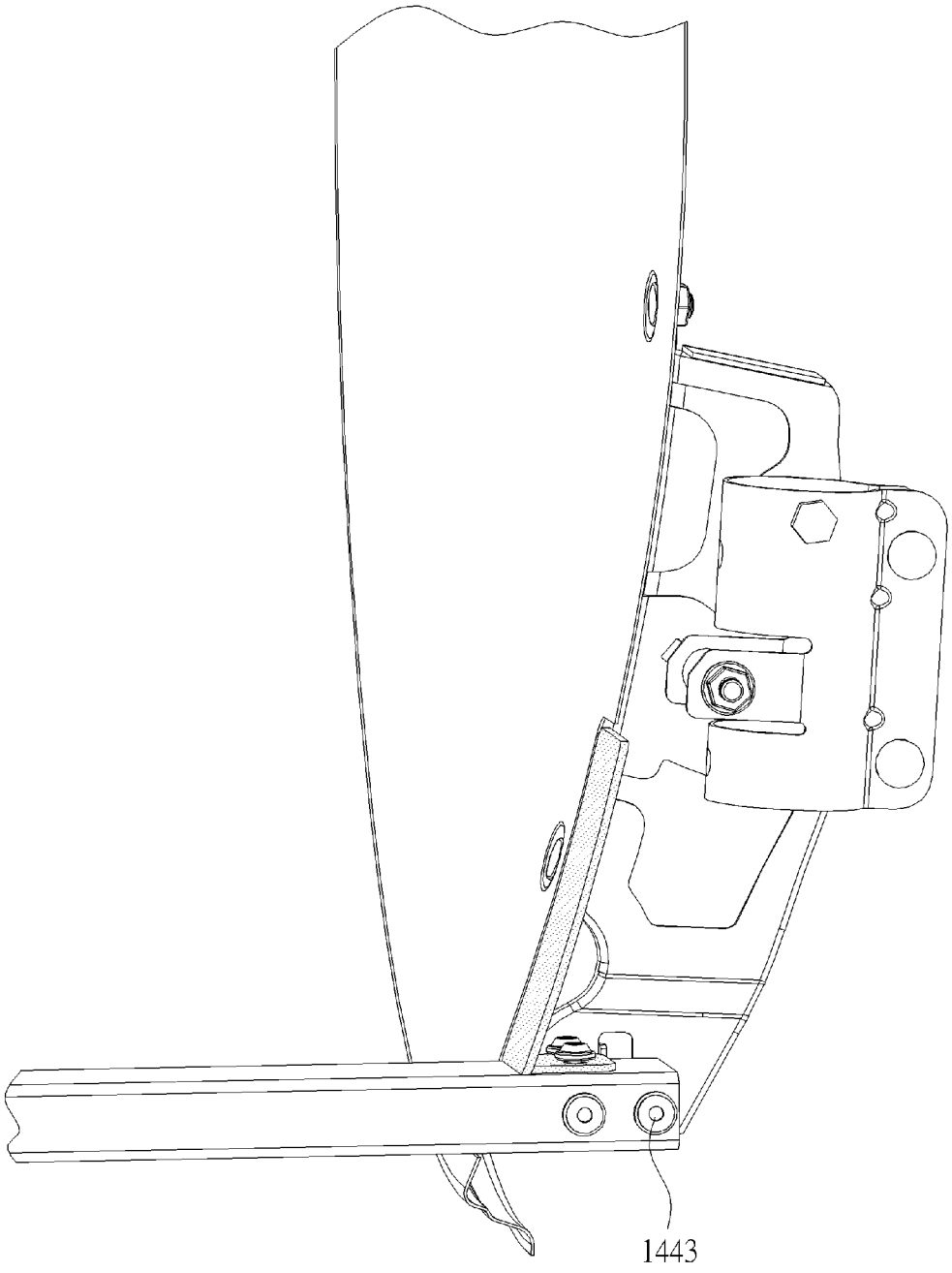
FIG. 14 illustrates a structural diagram of fixing the dish bracket, and the connecting rod.

Moreover, methods for fixing the dish bracket 34 and the connecting rod 32 in position are not limited, for example, in the first to fifth embodiments, the connector 343 shown in FIG. 3 may be screws for fixing the dish bracket 34 and the connecting rod 32 in position. Furthermore, please refer to FIG. 14, which illustrates a structural diagram of fixing the dish bracket and the connecting rod via rivet connection. As shown in FIG. 14, a connector 1443 rivets the dish bracket by a rivet to make the dish bracket 34 and the connecting rod 32 in position.

Furthermore, a relative position between the rotating center of the connecting rod 32 (i.e. the pivot 342) and the dish reflector 31 may be adjusted. For example, in the first to fifth embodiments, both the pivot 342 and the connector 341 shown in FIG. 3 are disposed at the back of the dish reflector 31. In other words, the connector 341 and the pivot 342 are disposed at the same side of the dish reflector 31 (i.e. back side).

Figure 15:
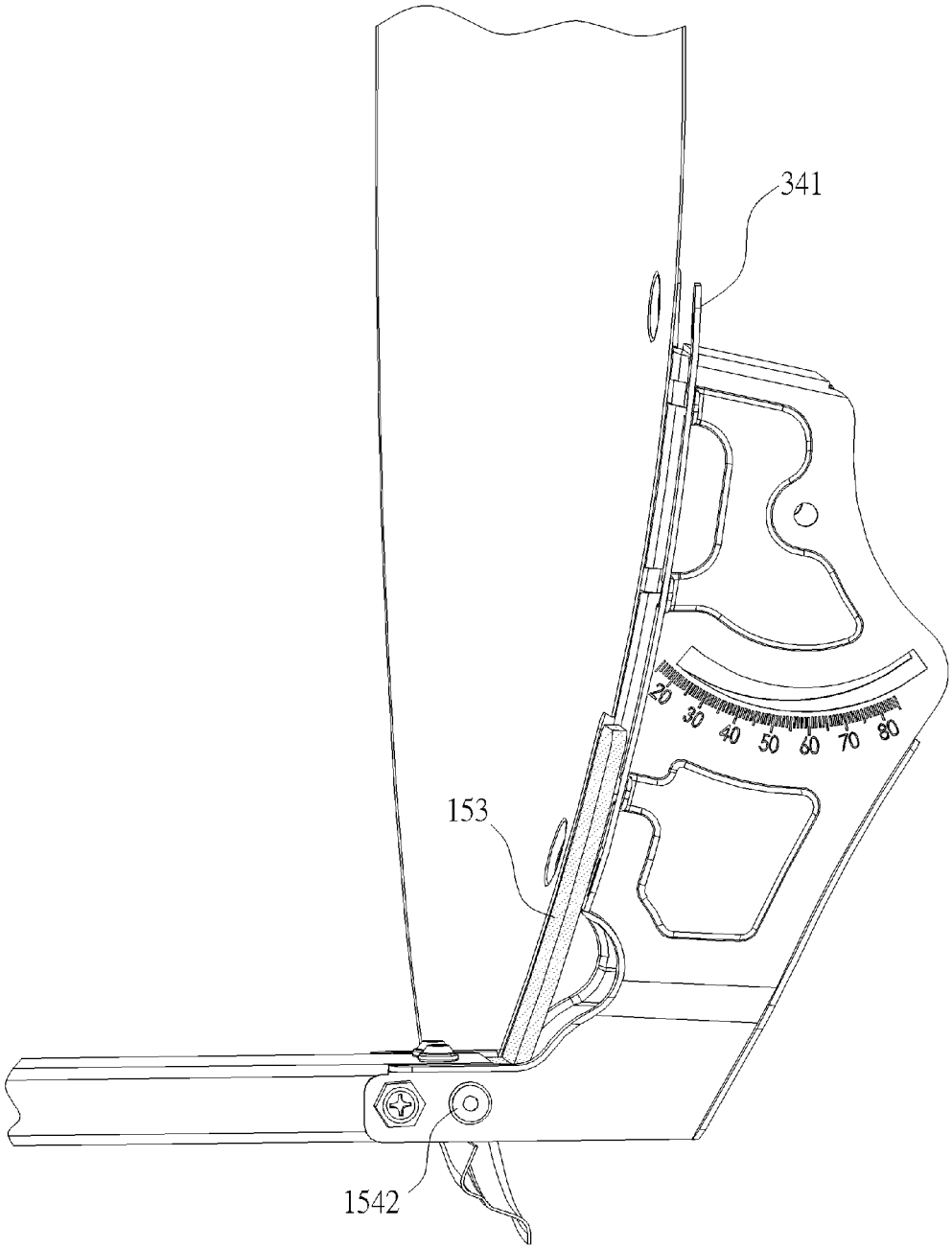
FIG. 15 illustrates the pivot disposed at a front side of the dish reflector according to a sixth embodiment of the present invention.

On the other hand, please refer to FIG. 15, which illustrates the pivot disposed at a front side of the dish reflector according to a sixth embodiment of the present invention. As shown in FIG. 15, a pivot 1542 is disposed at the front side of the dish reflector. In other words, the connector 341 and the pivot 1542 are respectively disposed at different sides of the dish reflector 31 (i.e. the back and front sides). In the sixth embodiment, the pivot disposed at the front side of the dish reflector may be combined with a connecting rod with a bend, wherein the connecting rod may have one or more bends, be a curved or straight rod. In addition, in this embodiment, a compensating structure 153 is screwed and inserted in the connecting rod, which is different from the fore embodiments that the compensating structure is screwed at an outer surface of the connecting rod (i.e. the embodiments illustrated in FIGS. 3, 7, 8 and 9).

In order to further reduce the volume of the semi-assembled satellite antenna, the holder of the compensating structure may include a connector and a pivot. The connector may be used for connecting the compensating plate and the holder, e.g. fix the holder on the connecting rod by screws. The pivot is coupled to the connector for pivotally connected to the compensating plate and the holder, such that the holder may be folded around the pivot. In such a structure, when the connecting rod is folded, the compensating plate may be folded to be disposed in parallel with the connecting rod; and when the connecting rod is expanded, the operator may simply expand the compensating plate to dispose the compensating plate in dish reflector, which may improve convenience and save times to the operator.

To sum up, the satellite antenna of the present invention may be semi-assembled in the production lines for a single package to simplify the installation procedures for the operator; and the satellite antenna of the present invention has the foldable connecting rod such that the volume of the semi-assembled satellite antenna may be reduced to reduce the packaging materials and the delivery spaces for a single package, which reduces a total operating cost for the satellite antenna. Meanwhile, the satellite antenna of the present invention is disposed with the compensating structure to ensure the intactness of the dish reflector, which may ensure the reception performance of the satellite antenna. As a result, the satellite antenna of the present invention may meet the requirements of quick installation, saving packaging materials and delivery spaces, as well as the reception performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable satellite antenna, comprising:

a dish reflector formed with an opening;

a connecting rod having a section smaller than the opening such that the connecting rod is able to be inserted through the opening to penetrate the dish reflector;

a compensating structure fixed on the connecting rod, wherein the compensating structure fills an area other than where the connecting rod penetrating the opening after the connecting rod is inserted through the opening to penetrate the dish reflector; and a dish bracket connected to the dish reflector and pivotally connected to the connecting rod such that the connecting rod and the compensating structure rotate relative to the dish bracket after the connecting rod is inserted through the opening to penetrate the dish reflector.

2. The satellite antenna of claim 1, wherein the dish bracket comprises:

a first connector for connecting the dish reflector; and a first pivot pivotally connected to the connecting rod, such that the connecting rod rotates around the first pivot.

3. The satellite antenna of claim 2, wherein the dish bracket further comprises a second connector for fixing the dish bracket and the connecting rod in position.

4. The satellite antenna of claim 2, wherein the first connector and the first pivot are disposed at a same side of the dish reflector.

5. The satellite antenna of claim 2, wherein the first connector and the first pivot are disposed at different sides of the dish reflector.

6. The satellite antenna of claim 1, wherein the compensating structure comprises:

a compensating plate; and a holder connected to the compensating plate and the connecting rod for fixing the compensating plate, and fixing the compensating structure on the connecting rod.

7. The satellite antenna of claim 6, wherein the compensating plate formed with a plurality of holes.

* * * * *